US009096094B2

(12) United States Patent
Kaishian et al.

(10) Patent No.: US 9,096,094 B2
(45) Date of Patent: Aug. 4, 2015

(54) STRETCHED ARTIST CANVAS WITH RIGID FOAM BACK

(71) Applicants: Steven Charles Kaishian, Wauwatosa, WI (US); Pamela Anderson, Wauwatosa, WI (US)

(72) Inventors: Steven Charles Kaishian, Wauwatosa, WI (US); Pamela Anderson, Wauwatosa, WI (US)

( * ) Notice: Subject to any disclaimer, the term of this patent is extended or adjusted under 35 U.S.C. 154(b) by 43 days.

(21) Appl. No.: 13/887,273

(22) Filed: May 3, 2013

(65) Prior Publication Data

US 2014/0326420 A1 Nov. 6, 2014

(51) Int. Cl.
*A47G 1/06* (2006.01)
*B44D 3/18* (2006.01)

(52) U.S. Cl.
CPC ..... *B44D 3/185* (2013.01)

(58) Field of Classification Search
CPC ..... B44D 3/185
USPC ..... 160/371, 380, 351, 135; 40/740, 773, 40/745, 732, 791, 768; 52/222; 38/102.2
See application file for complete search history.

(56) References Cited

U.S. PATENT DOCUMENTS

| | | | | |
|---|---|---|---|---|
| 1,842,473 | A * | 1/1932 | Glassner | 40/754 |
| 3,657,796 | A * | 4/1972 | Gochnauer | 29/432 |
| 5,404,663 | A * | 4/1995 | Schober | 40/768 |
| 5,515,628 | A * | 5/1996 | Rankin | 40/700 |
| 2003/0196364 | A1 * | 10/2003 | Chang | 40/732 |
| 2009/0293333 | A1 * | 12/2009 | Heidrich | 40/745 |
| 2013/0059126 | A1 * | 3/2013 | Ridless et al. | 428/175 |

* cited by examiner

*Primary Examiner* — Blair M Johnson

(57) ABSTRACT

A stretched artist canvas frame system is supported with a rigid foam back to either allow artists to apply pressure to a canvas without stretching it and causing sagging, or to allow artists to use the stretched artist canvas as an alternative for artists who paint on board. The frame system is a light weight alternative to painting on board, especially when the paintings become very large. The frame system provides the texture of canvas but the stiffness of a board by supporting the board with a lightweight rigid extruded foam. The frame system gives the artist the choice of painting on canvas or the feel of painting on board. The rigid foam back allows the artist to even create a smooth board finish if they choose through priming techniques. As the canvas gets larger, they do not get prohibitively heavier.

9 Claims, 3 Drawing Sheets

STRETCHED ARTIST CANVAS WITH RIGID FOAM BACK

BACKGROUND OF THE INVENTION

The present invention relates to art accessories and, more particularly, to a stretched artist canvas that is supported with a rigid foam back, allowing an artist to either apply pressure to a canvas without stretching it to cause sagging or as an alternative for artists who paint on board.

Artists that paint on board limit the size of their work as the framing and painting surface gets too heavy. In addition, larger paintings get more costly and difficult to ship.

Traditional canvas that is stretched over a frame will stretch and sag over time for any artist that uses aggressive methods as the art is created. The over stretched canvas is difficult to work with and eventually interferes with the cross-bracing in the back of the frame.

As can be seen, there is a need for a stretched artist canvas that allows an artist to apply pressure to a canvas without stretching it to cause the canvas to sag.

SUMMARY OF THE INVENTION

In one aspect of the present invention, a frame system comprises a plurality of back frame pieces attached together to form an outer periphery; a rigid foam board attached to the plurality of back frame pieces, the rigid foam board having an outer periphery matching the outer periphery of the plurality of back frame pieces; and a plurality of side board pieces attached to the outer periphery of the back frame pieces, the plurality of side board pieces having a top side that is substantially flush with a top side of the rigid form board.

In another aspect of the present invention, a frame system comprises a plurality of back frame pieces attached together to form an outer periphery; a rigid foam board attached by an adhesive to the plurality of back frame pieces, the rigid foam board having an outer periphery matching the outer periphery of the plurality of back frame pieces; and a plurality of side board pieces attached to the outer periphery of the back frame pieces, the plurality of side board pieces having a top side that is substantially flush with a top side of the rigid form board, wherein the plurality of back frame pieces are attached together with back frame piece assembly screws fitting into back frame piece assembly screw pocket holes; the plurality of side board pieces are attached to the plurality of back frame pieces with a plurality of side piece attachment screws inserted into side piece attachment screw pocket holes in the plurality of back frame pieces; and a back side of the plurality of side frame pieces are substantially flush with the plurality of back frame pieces.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a stretched artist canvas frame system that is supported with a rigid foam back to either allow artists to apply pressure to a canvas without stretching it and causing sagging, or to allow artists to use the stretched artist canvas as an alternative for artists who paint on board. The frame system is a light weight alternative to painting on board, especially when the paintings become very large. The frame system of the present invention provides the texture of canvas but the stiffness of a board by supporting the board with a lightweight rigid extruded foam. The frame system gives the artist the choice of painting on canvas or the feel of painting on board. The rigid foam back allows the artist to even create a smooth board finish if they choose through priming techniques. As the canvas gets larger, they do not get prohibitively heavier.

Figure 1:
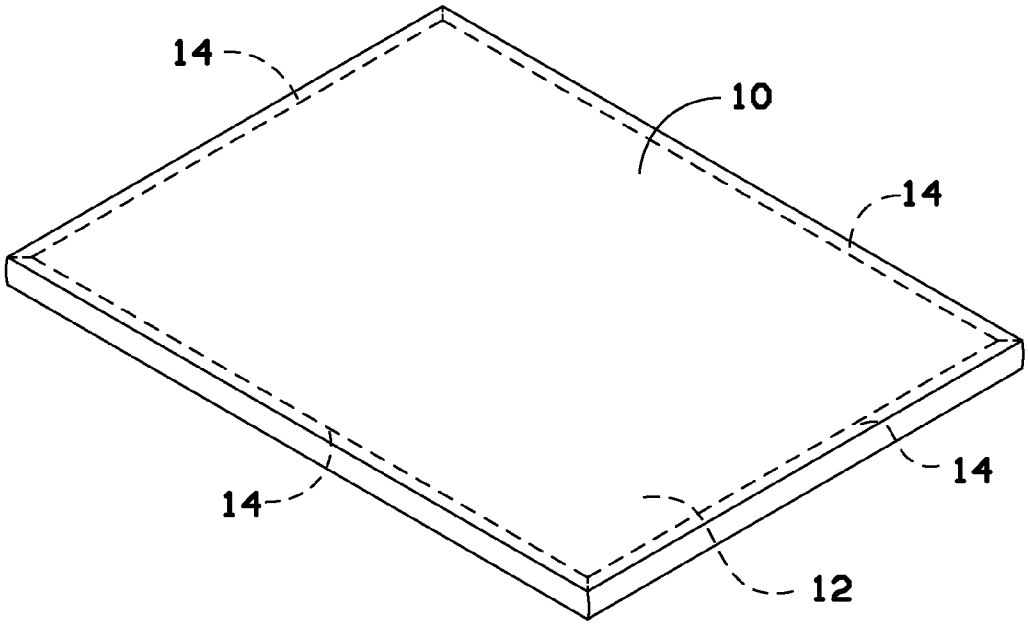
FIG. 1 is a front perspective view of an artist canvas according to an exemplary embodiment of the present invention.
Figure 2:
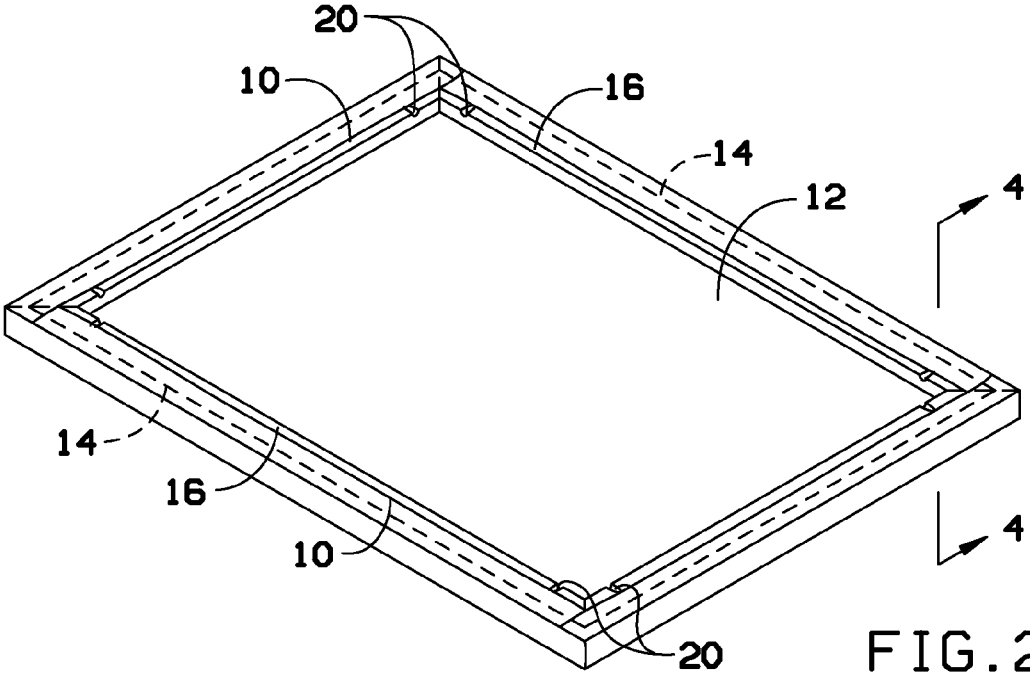
FIG. 2 is a back perspective view of the artist canvas of FIG. 1.
Figure 3:
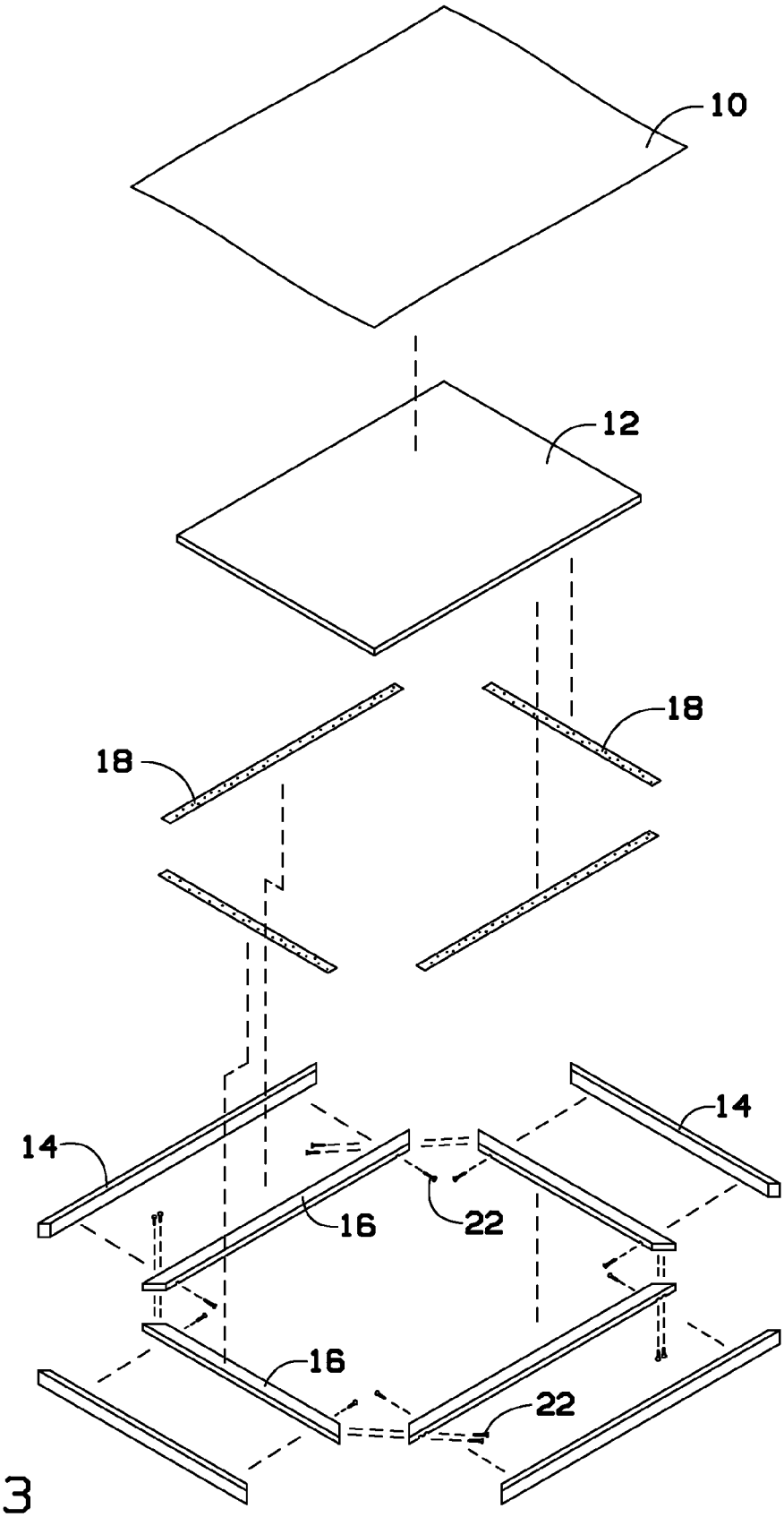
FIG. 3 is a exploded perspective view of the artist canvas of FIG. 1.
Figure 4:
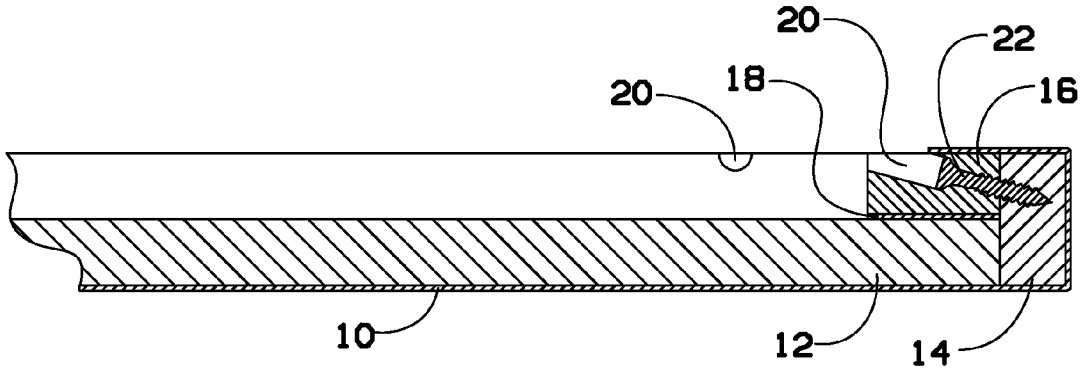
FIG. 4 is a cross-sectional view taken along line 4-4 of FIG. 2.
Figure 5:
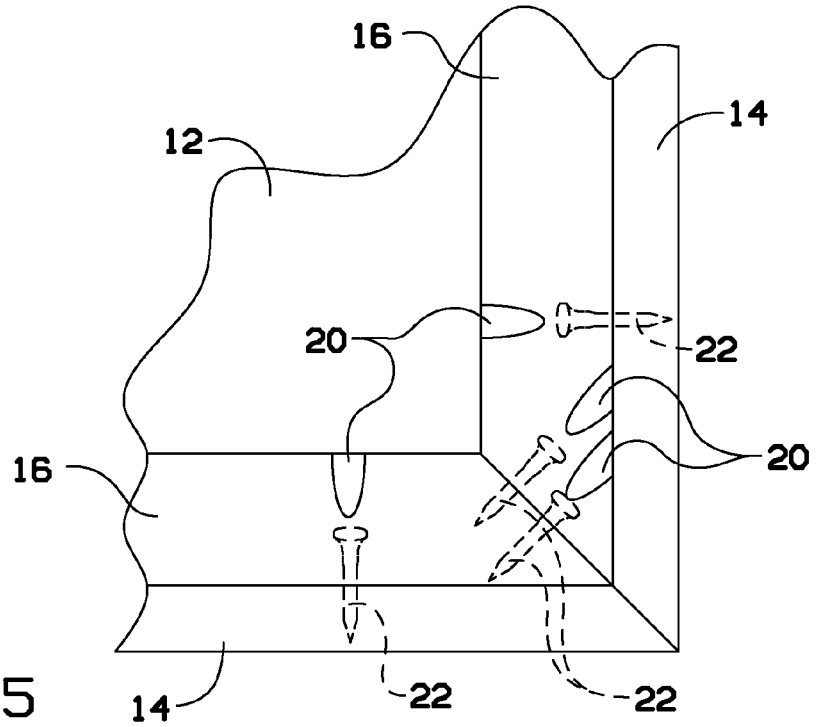
FIG. 5 is a detailed bottom view of the artist canvas of FIG. 1, with the canvas removed for clarity.

Referring now to FIGS. 1 through 5, a framing system for holding a canvas 10 can include a plurality of back frame pieces 16 connected together in a desired shape, such as rectangular, as shown in the Figures. Of course, the back frame pieces 16 can be disposed in other shapes, including geometric and not geometric shapes.

The back frame pieces 16 can be connected together with screws 22 that can be inserted into screw pocket holes 20 formed in a first back frame piece 16 to allow screws 22 to pass into the screw pocket holes 20, through the first back frame piece and into an adjacent back frame piece.

A rigid foam board 12 can be attached to the back frame pieces 16 by various methods. For example, a double-sided tape 18 can be used to secure the rigid foam board 12 to the back frame pieces 16. The rigid foam board 12 is designed to have an outer perimeter that matches the outer perimeter of the back frame pieces 16.

A plurality of side frame pieces 14 can fit about the back frame pieces 16. Screws 22 can be inserted into screw packet holes 20 in the inside periphery of the back frame pieces 16 and be secured to the side frame pieces 14 to hold them in place. A top side of the side frame pieces 14 can be positioned to be flush with the rigid foam board 12. Typically, a back side of the side frame pieces 14 can be positioned to be flush with the back side of the back frame pieces 16.

The rigid form board 12 creates a flat supported surface for the canvas 10 that is now integral to the canvas framing. Typically, the back and side frame pieces 16, 14 use traditional mitered corner woodworking techniques. The canvas 10 can be stretched over the foam and side frame pieces 14 and attached at the back side as is known in the art.

The artist can use the frame system of the present invention as they would any other medium—with a stretched canvas or a framed board work surface.

It should be understood, of course, that the foregoing relates to exemplary embodiments of the invention and that modifications may be made without departing from the spirit and scope of the invention as set forth in the following claims.

What is claimed is:

1. A frame system comprising:

a plurality of back frame pieces attached together to form an outer periphery;

a rigid foam board attached to the plurality of back frame pieces, the rigid foam board having an outer periphery matching the outer periphery of the plurality of back frame pieces;

a plurality of side board pieces attached to the outer periphery of the back frame pieces, the plurality of side board pieces having a top side that is substantially flush with a top side of the rigid foam board; and a canvas stretched over the rigid foam board and the plurality of side frame pieces, the canvas attached to a back side of the frame system.

2. The frame system of claim 1, further comprising an adhesive attaching the rigid foam board with the plurality of back frame pieces.

3. The frame system of claim 2, wherein the adhesive is a double-sided tape.

4. The frame system of claim 1, wherein the plurality of back frame pieces are attached together with screws fitting into screw pocket holes.

5. The frame system of claim 1, wherein the plurality of side board pieces are attached to the plurality of back frame pieces with a plurality of screws inserted into screw pocket holes in the plurality of back frame pieces.

6. The frame system of claim 1, wherein a back side of the plurality of side frame pieces are substantially flush with the plurality of back frame pieces.

7. A frame system for supporting stretched canvas, comprising:

a plurality of side board pieces attached together to form an outer pieces periphery and an inner pieces periphery;

a rigid light weight board having an outer board periphery, wherein the outer board periphery is attached along the inner pieces periphery, and wherein the rigid light weight board has a top side that is substantially flush with a top side of the plurality of side board pieces; and a canvas stretched over the rigid light weight board and the plurality of side board pieces, the canvas attached to a back side of the plurality of side board pieces.

8. The frame system for supporting stretched canvas of claim 7, wherein the rigid light weight board is a foam board.

9. The frame system for supporting stretched canvas claim 7, wherein the plurality of side board pieces are attached together with screws fitting into screw pocket holes.

* * * * *